United States Patent [19]

Frehn

[11] 4,180,401

[45] Dec. 25, 1979

[54] SINTERED STEEL ALLOY

[75] Inventor: Fritz Frehn, Krefeld, Fed. Rep. of Germany

[73] Assignee: Thyssen Edelstahlwerke Aktiengesellschaft, Krefeld, Fed. Rep. of Germany

[21] Appl. No.: 810,731

[22] Filed: Jun. 28, 1977

[30] Foreign Application Priority Data

Jul. 6, 1976 [DE] Fed. Rep. of Germany ..... 2630266

[51] Int. Cl.[2] ..... B22F 3/00; C22C 29/00

[52] U.S. Cl. ..... 75/236; 75/241

[58] Field of Search ..... 75/238, 237, 241, 236, 75/123 J, 123 K, 123 M

[56] References Cited

U.S. PATENT DOCUMENTS

| | | | |
|---|---|---|---|
| 3,369,891 | 2/1968 | Tarkan | 75/204 |
| 3,450,511 | 6/1969 | Frehn | 75/237 |
| 3,746,519 | 7/1973 | Hara et al. | 148/126 |
| 3,809,540 | 5/1974 | Mal et al. | 75/237 |
| 3,837,816 | 9/1974 | Takahashi et al. | 75/237 |

*Primary Examiner*—Brooks H. Hunt

*Attorney, Agent, or Firm*—Kenyon & Kenyon

[57] ABSTRACT

A sintered steel alloy, particularly for hot-working tools, of the type comprising a hard metal compound such as titanium carbide and a matrix alloy of nickel martensitic steel containing at least a small amount of titanium, is featured by a substantially higher than usual molybdenum content providing an improvement in toughness and hardness when appropriately heat treated.

8 Claims, 1 Drawing Figure

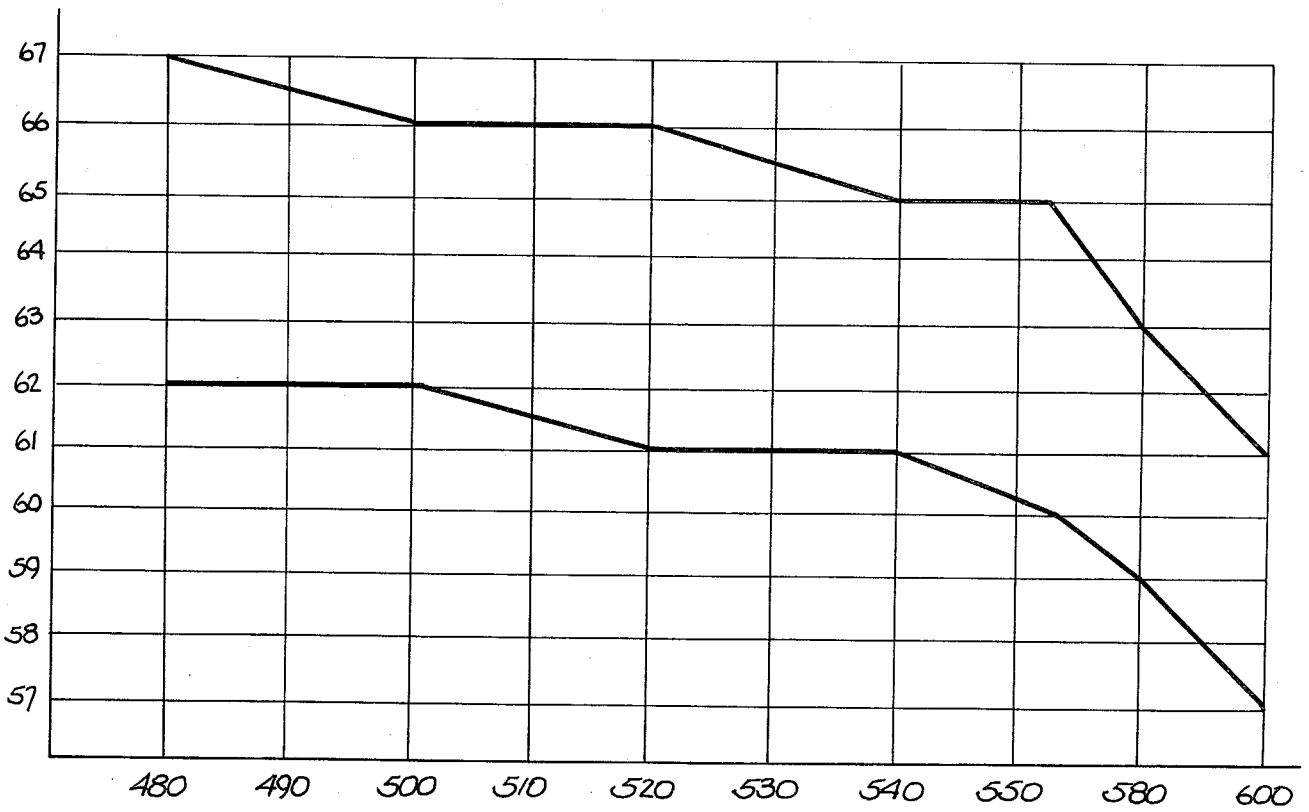
67
66
65
64
63
62
61
60
59
58
57
480
490
500
510
520
530
540
550
580
600

SINTERED STEEL ALLOY

BACKGROUND OF THE INVENTION

Steel alloys containing hard metal compounds, exemplified by titanium carbide, are necessarily made by powdered metal metallurgical techniques. Such an alloy comprises the hard metal compound particles dispersed in a steel matrix. Although used for cold-working tools, and certain structural parts, they are particularly adapted for tools and other parts subjected to wear when working at high temperatures.

From the German Pat. Nos. 1 257 440 and 1 558 477, sintered steel alloys are known with 27 to 35% TiC and a matrix alloy of

| | |
|---|---|
| less than | 0.03% C |
| | 3 to 7% Mo |
| | 12 to 26% Ni |
| | 5 to 11% Co |
| | 0.15 to 2.4% Ti |
| | 0.05 to 0.6% Al |
| | 0.02% B, |
| remainder, Fe, | |

where 50% of the Ni content can be replaced by Cr.

From the German Pat. Nos. 1 298 293 and 2 061 486, the following sintered steel alloys are known:

| | | |
|---|---|---|
| 20 to 80% by volume TIC and remainder, i.e., | | |
| 20 to 80% by volume steel with | | |
| 10 to 36% by weight | Ni | |
| 0.2 to 9% | Ti | |
| up to 5% | Al, | the sum Ti + Al not to exceed 9% |
| up to 25% | Co | |
| up to 10% | Mo, | |
| remainder, Fe | | |

or with

| | | |
|---|---|---|
| 12 to 20% by weight | Cr | % Cr/2 + Ni not to exceed 15% |
| 4 to 10% | Ni | |
| 3 to 10% | Co | |
| up to 5% | Mo | |
| 0.5 to 5% | Ti | |
| up to 5% Al | | |
| less than 0.02% | C, | |
| Remainder at least 50% Fe. | | |

These prior art sintered steels carry the hard metal compound in a matrix of steel containing sufficient nickel to make the steel more or less martensitic and which, therefore, can be called nickel-martensitic steel alloys. In addition, it is to be noted that their molybdenum contents do not exceed 10% by weight. It has heretofore been believed that a molybdenum content exceeding this value would result in the alloy being excessively brittle.

SUMMARY OF THE INVENTION

According to the present invention, a sintered steel alloy of the type described, by weight consists essentially of from 12 to 60% TiC and from 40 to 88% of steel consisting essentially of:

| | |
|---|---|
| 0 to 0.10% | C |
| 12. to 25. % | Mo |
| 8. to 26. % | Ni |
| 10. to 20. % | Co |
| 0.2 to 2. % | Ti |
| 0 to 1.0 % | Al |
| 0 to 2.0 % | Cu |
| 0 to 2.0 % | Mn |
| 0 to 0.08% | B |
| Remainder | Fe |

In the above the molybdenum content is increased substantially above the 10% maximum value heretofore considered to be the permissible value. Surprisingly, an increase in both toughness and hardness are obtained. The heat treatment required is simple, comprising only a solution anneal followed by precipitation hardening. Hardness values of from 65 to 70 Rockwell C are obtainable, values not heretofore achieved by precipitation hardening alloys of the type described with the steel matrix being an essentially nickel-martinsitic steel.

BRIEF DESCRIPTION OF THE DRAWING

The accompanying drawing graphically shows the increase in hardness obtained after the solution anneal and after subsequent precipitation hardening.

DETAILED DESCRIPTION OF THE INVENTION

As previously indicated, the sintered steel alloy of the present invention in its broadest aspect by weight consists essentially of from 12 to 60% TiC and from 40 to 88% steel consisting essentially of

| | |
|---|---|
| 0 to 0.10% | C |
| 12. to 25. % | Mo |
| 8. to 26. % | Ni |
| 10. to 20. % | Co |
| 0.2 to 2. % | Ti |
| 0 to 1.0 % | Al |
| 0 to 2.0 % | Cu |
| 0 to 2.0 % | Mn |
| 0 to 0.08% | B |
| Remainder | Fe |

However, the preferred composition by weight consists essentially of from 20 to 35% titanium carbide and 65 to 80% by weight of steel consisting essentially as follows:

| | |
|---|---|
| 13 to 16 % | Ni |
| 14 to 17 % | Mo |
| 15 to 18 % | Co |
| 0.2 to 0.6 % | Ti |
| 0 to 0.6 % | Cu |
| 0 to 0.02% | B |
| 0 to 0.05% | C |
| Remainder | Fe. |

In either of the above two compositions up to 50% of the titanium carbide can be replaced by a hard metal compound selected from the class consisting of TaC, ZrC, CrC, VC, NbC, TiN and WC. These may be used singly or in various combinations.

After a solution heat treatment at 840° C., these new alloys reach a hardness of from 50 to 52 Rockwell C, and in spite of their larger than usual molybdenum content they can be machined without difficulty. Subsequent precipitation heat treatment of from 6 to 8 hours at 480° C. yields the surprisingly high hardness values of 65 to 70 Rockwell C. Such high hardness has not been attainable before with alloys of the type described and using a maxtrix of nickel martensitic steel. The results obtained are illustrated by the attached drawing which is self-explanatory.

In the case of the preferred composition of the new alloy it will be noted that the aluminum content is maintained as close to zero as possible. With an appreciable content of aluminum the alloy has the disadvantage of being subject to substantial embrittlement. Even so, it can be used for parts which do not require the toughness possible in those cases when aluminum is avoided.

Apparently the prior art has not considered manganese to be useful in alloys of the type described. In the case of the present invention it has been found that manganese might be provided particularly if the alloy is to be stressed under corrosive conditions. The addition of manganese of up to 2% hardens the matrix of the intrinsically soft, scaly nickel-martensite without making the machinability of the alloy appreciably worse. The manganese prevents the typical washouts which occur in connection with erosion wear.

Titanium is required in amounts of at least 0.2% in order to make hardening of the alloy possible, but increasing the titanium content beyond 2.0% causes embrittlements, and this has a negative effect on the toughness characteristics of the new alloy.

Nickel below 8% restricts the formation of the nickel-martensite and a content above 26% would be unecomonical.

Cobalt, if added in an amount of at least 10%, largely prevents solubility of the molybdenum in the solid solution, so that it is available for the intermetallic precipitates, particularly $Fe_2Mo$, which are necessary for increasing the hardness. A Co-content beyond 20% showed a no more positive effect on the overall alloy.

The addition of boron serves to facilitate sintering (deoxidation) and should not exceed 0.08%, as brittle boron compounds are formed at the grain boundaries.

A Cu-addition of up to 2% serves for additionally increasing the hardness due to precipitates, but also produces an additional lubricating effect in tools according to the invention for the entire metal working technology and in parts subject to wear.

The following advantages over known alloys are listed:

Increased hardness from 480° C. to 600° C. for the same annealing hardness of 50 HRC (Rockwell C)

| | Present Alloys | Alloys as per Invention |
|---|---|---|
| 480° C. | 62 HRC | 67 HRC |
| 500° C. | 62 HRC | 66 HRC |
| 520° C. | 61 HRC | 66 HRC |
| 540° C. | 61 HRC | 65 HRC |
| 560° C. | 60 HRC | 65 HRC |
| 580° C. | 59 HRC | 63 HRC |
| 600° C. | 57 HRC | 61 HRC |

The hardness of an alloy of the prior art and one of this invention is plotted as a function of temperature in the drawing, with the upper curve being the curve for the alloy of this invention.

-continued

| Increased bending strength | Present Alloys | Alloys as per Invention |
|---|---|---|
| | 1200 to 1600 N/mm$^2$ | 2000 to 2400 N/mm$^2$ |

Better thermal conductivity

Nitration by one of the known processes produces greater and more uniform surface hardness, with likewise increased base hardness. With increasing nitration temperature, the base hardness drops off less, as the annealing curve is considerably higher.

Application of these alloys as hot-working tools, where temperatures above 650° C. occur at the contact surface between the hot material (1000° C.) and the tools, may require use in solution-annealed condition. Also in this case, the better thermal conductivity of the alloys according to the invention has a positive effect on the service life of the tool and the resistance to hot cracking.

It is a particular advantage of the alloy according to the invention that it can be used also in the solution-annealed condition for deforming tools at higher temperatures. This is due to the high annealing hardness and the carbide component, which is completely absent in prior art steels of this group. The advantage is furthermore seen in the fact that the nickel martensite alloy does not undergo a conversion in the heating. This eliminates large volume changes which lead to early hot cracking. The cooling-down following the heating-up of the tools can cause only modest precipitation of intermetallic compounds which, in addition to an increase in hardness, cause only a negligible decrease in volume. Heating-up and cooling-down occur in time periods to short that one can talk neither of regular solution annealing nor of exact precipitation.

The alloy according to the invention is particularly well suited for any tools and parts subject to wear which must withstand extraordinarily large bending forces with, at the same time, high wear resistance, e.g., long cutting and bending punches, rotor shafts, spindles for grinding and cutting tools and for valves, where the high damping coefficient of the new alloys has an additional positive effect; for parts which must exhibit high tensile strength such as for use as pressure plates of all kinds, tools for working plastic materials of all kinds, particularly those with abrasive fillers, and, in general, parts or tools which must have adequate hot hardness at temperatures above 500° C.

It is to be noted that although in these new alloys up to 50% of the TiC can be replaced by other hard metal compounds, that the TiC contents of the alloys should always be 50% of the total of the hard metal compounds used. It is at present considered possible that the unexpected hardness-and-toughness-without-embrittlement characteristics of the new alloys may be due to the partial solubility of TiC in the Mo.

The method of making the new alloys has not been described because they may be made by the prior art powdered metal practices used to make alloys of the same general type.

In describing the new alloys hereinabove and in the claims which follow all references to percentages have reference to percent by weight.

What is claimed is:

1. A sintered steel alloy by weight consisting essentially of from 12 to 60% TiC and from 40 to 88% of steel consisting essentially of:

| | |
|---|---|
| 0 to 0.10% | C |
| 12. to 25. % | Mo |
| 8. to 26. % | Ni |
| 10. to 20. % | Co |
| 0.2 to 2. % | Ti |
| 0 to 1.0 % | Al |
| 0 to 2.0 % | Cu |
| 0 to 2.0 % | Mn |
| 0 to 0.08% | B |
| Remainder | Fe |

2. The alloy of claim 1 by weight consisting essentially of 20 to 35% TiC and from 65 to 80% steel consisting essentially of:

| | |
|---|---|
| 13 to 16 % | Ni |
| 14 to 17 % | Mo |
| 15 to 18 % | Co |
| 0.2 to 0.6 % | Ti |
| 0 to 0.6 % | Cu |
| 0 to 0.02% | B |
| 0 to 0.05% | C |

-continued

| | |
|---|---|
| Remainder | Fe |

3. The alloy of claim 1 in which up to 50% of said TiC is replaced by a compound selected from the class consisting of TaC, ZrC, CrC, VC, NbC, TiN and WC.

4. The alloy of claim 2 in which up to 50% of said TiC is replaced by a compound selected from the class consisting of TaC, ZrC, CrC, VC, NbC, TiN and WC.

5. The alloy of claim 1 precipitation hardened to a hardness of at least 65 to 70 Rockwell C, by being heated to about 480° C. for 6 to 8 hours after solution annealing.

6. The alloy of claim 2 precipitation hardened to a hardness of at least 65 to 70 Rockwell C, by being heated to about 480° C. for 6 to 8 hours after solution annealing.

7. The alloy of claim 3 precipitation hardened to a hardness of at least 65 to 70 Rockwell C, by being heated to about 480° C. for 6 to 8 hours after solution annealing.

8. The alloy of claim 4 precipitation hardened to a hardness of at least 65 to 70 Rockwell C, by being heated to about 480° C. for 6 to 8 hours after solution annealing.

* * * * *